US005547768A

United States Patent [19]

Topolski et al.

[11] Patent Number: 5,547,768

[45] Date of Patent: Aug. 20, 1996

[54] CORROSION RESISTANT NICKEL OXIDE SURFACE COATING

[75] Inventors: Mark J. Topolski, Jackson Township, Stark County; James M. Tanzosh, Silver Lake, both of Ohio

[73] Assignee: The Babcock & Wilcox Company, New Orleans, La.

[21] Appl. No.: 418,390

[22] Filed: Apr. 7, 1995

[51] Int. Cl.[6] ..... B32B 15/04; B05D 3/02

[52] U.S. Cl. ..... 428/632; 428/680; 428/469; 427/305; 427/419.2

[58] Field of Search ..... 428/629, 632, 428/680, 469; 427/376.2, 376.4, 376.5, 419.2, 305; 138/146

[56] References Cited

U.S. PATENT DOCUMENTS

| | | | |
|---|---|---|---|
| 3,646,993 | 3/1972 | Rice et al. | 165/9 |
| 3,730,538 | 5/1973 | Silverstone et al. | 277/96 K |
| 4,104,134 | 8/1978 | Roberts et al. | 428/629 |
| 4,452,233 | 6/1984 | Goodman et al. | 126/443 |
| 4,584,085 | 4/1986 | Beaver et al. | 428/633 |
| 4,639,399 | 1/1987 | Aprigliano | 428/632 |
| 4,658,761 | 8/1987 | Duggan | 122/235 |
| 4,959,247 | 9/1990 | Moser et al. | 427/226 |
| 5,190,832 | 7/1993 | Ogawa et al. | 438/678 |
| 5,336,567 | 8/1994 | Watanabe et al. | 428/629 |
| 5,344,502 | 4/1994 | Mack et al. | 148/236 |

FOREIGN PATENT DOCUMENTS

| | | | |
|---|---|---|---|
| 60-110882 | 6/1985 | Japan | 427/376.2 |
| 60-110884 | 6/1985 | Japan | 427/376.2 |

OTHER PUBLICATIONS

Gadalla, A. M. & Yu, Hsuan–Fu, "Thermal Behaviour of Ni(II) Nitrate Hydrate and its Aerosols", *Journal of Thermal Analysis,* vol. 37, 1991. pp. 319–331. no month.

Messing, G. L. & Minehan, W. T., "Synthesis of Ceramic Powders from Metal Alkoxides", *The Ceramics Society of Japan,* The Centennial Memorial Issue, Issue 99[10], 1991. pp. 1036–1046.

*Primary Examiner*—John Zimmerman

*Attorney, Agent, or Firm*—Robert J. Edwards; Eric Marich

[57] ABSTRACT

A method for coating a substrate with a corrosion resistant surface comprises the steps of coating a portion of the substrate with a nickel (II) nitrate hexahydrate solution. The solution-coated substrate is then heated to a temperature greater than 303° C. until a nickel oxide coating remains.

15 Claims, 1 Drawing Sheet

Figure
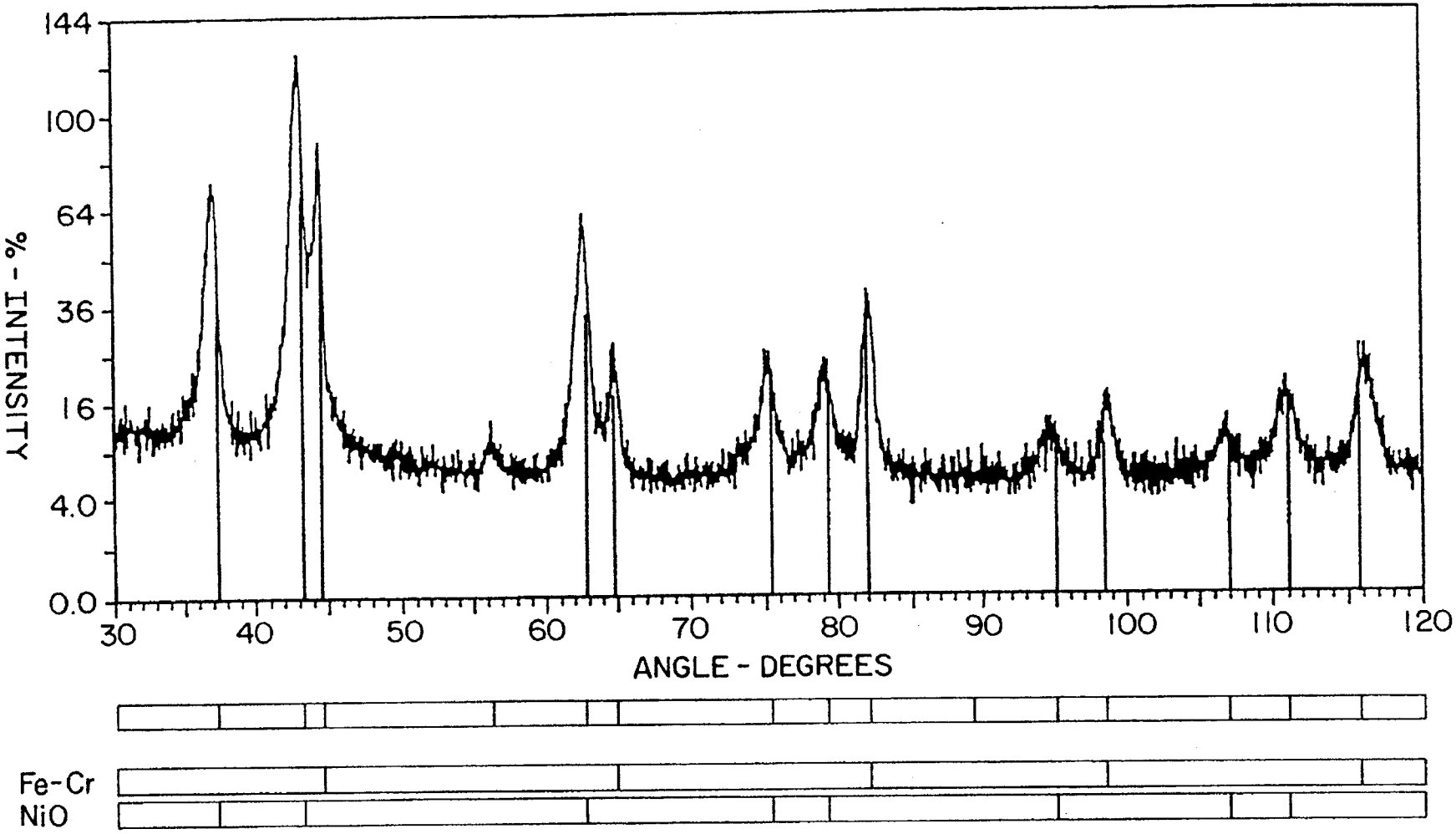

CORROSION RESISTANT NICKEL OXIDE SURFACE COATING

FIELD AND BACKGROUND OF THE INVENTION

The present invention relates, in general, to coating methods and, in particular, to a new and useful method for coating a surface with corrosion resistant nickel oxide. Tubes, pipe, or plate provided with the nickel oxide coating produced according to the present invention are particularly suited for service environments in refuse boilers burning processed and bulk municipal waste. The fuels burned in such refuse boilers are substantially higher in chlorine content, thus producing corrosive conditions much different than that typically encountered in utility power boilers burning coal and/or oil.

Corrosion resistant surface coatings on substrates can be produced by many different methods. For instance, coatings may be applied by painting, thermal spray, or metallurgical bonding methods. The method used generally depends on several factors such as the coating material being applied, the substrate material, the required coating integrity, and the required coating/substrate bond strength. The applied coating material in the known methods is generally put into service in the as-applied state.

Fine NiO powders have been produced for the ceramic industries through one known technique using the pyrolysis of an aerosol of a nickel nitrate solution.

This method is described in Gadalla et al., "Thermal Behavior of Ni(II) Nitrate Hydrate and Its Aerosols", Journal of Thermal Analysis, Vol. 37 (1991) 319–331 and Messing et al., "Synthesis of Ceramic Powders From Metal Alkoxides", Journal of the Ceramic Society of Japan, The Centennial Memorial Issue 99 [10] 1036–1046 (1991).

Duggan (U.S. Pat. No. 4,658,761) discloses a prior art technique used in the treatment of boiler tubes to improve their corrosion and erosion resistance. Metallized or non-metallized coatings are impregnated with at least one stable metal oxide by solutions containing salts or oxides of such metals. Preferably, a metal boiler tube having at least a selected part of its surface initially porous is coated with at least one stable metal oxide by the application to the porous surface of a solution or suspension containing salts or oxides of such metals followed by conversion of such salts or treatment of such oxides of metals to attach the stable metal oxides to the porous surface. A slurry may be used which is a liquid based mixture of one or more finely divided refractory oxides which may optionally contain a small amount of impregnating solution, a small amount of organic wetting agent, or ceramic reinforcement fibers. The slurry itself may contain a high percentage of metal powder including chromium or nickel-chromium alloy, and other finely powdered materials of high abrasion or corrosion-resisting capacity, for example silicon carbide, boron carbide, and titania-lead glass. The slurries may be applied directly to the metal surface. Additionally, preferred metal coatings to be applied according to the Duggan patent may be selected from the following: nickel-chrome alloy, nickel-aluminide alloy, and high chrome iron alloy. The metal coating may serve the role of a stress-relieving layer upon which a further layer, comprising oxide or metal, may be applied. Suitable compounds capable of conversion to stable metal oxides and which are soluble include, for example, cerrous nitrate, zirconyl chloride, cobalt and nickel nitrates, titanium oxalate, silicotungstic acid, magnesium chromate, beryllium nitrate, chromium trioxide, chromium sulphate, chromium chloride, and the like. Finally, the application to the porous tube surface of a concentrated solution of chromic acid is particularly preferred, and results in a chromium oxide protective layer which is an effective corrosion inhibitor when sulfur compounds are the predominant corrosion agent, for example coal ash corrosion in utility boilers. The chromium also helps to resist normal oxidation. However, chromium compounds are not resistant to chloride-bearing corrodents such as those which occur in refuse boilers.

The corrosive environment typically encountered in coal and/or oil fired boilers of electric utility generating stations is significantly different from that encountered in refuse fired boilers burning processed and bulk municipal waste. The reason for this difference is the type of fuel being burned and the corrosive agents within that fuel. Chlorine exists in some coals in sufficient quantities to contribute, with the sulfur in the coal, to increased corrosion attack of boiler materials. However, the amount of chlorine in refuse is significantly higher, and the sulfur is generally usually very low. This creates a corrosion condition that is much different than that encountered in power boilers. In fact, some of the coatings that help protect against corrosion in power boiler environments are usually based upon increased chromium content materials or coatings, and thus do not work in the refuse boiler environment. An additional corrodent found in refuse that does not appear to any significant degree in coal or oil are low melting point elements, such as lead an zinc. These elements form low melting point eutectic compositions when combined with chlorine, and which are very corrosive to normal iron-based boiler materials. The most effective material found to consistently resist attack in refuse boiler environments are nickel and nickel-oxide based systems. Chromium oxides, the preferred embodiments of the Duggan patent, will simply not provide any significant degree of corrosion protection in a refuse fired boiler burning processed and bulk municipal waste.

SUMMARY OF THE INVENTION

The present invention converts a liquid coating of one material, i.e. nickel II nitrate hexahydrate, to a solid coating of another material, i.e. nickel oxide (NiO) by thermal decomposition. The present invention provides a method for converting a nickel (II) nitrate hexahydrate solution coating to a nickel oxide (NiO) ceramic coating on tube samples. The invention uses the thermal decomposition characteristics of nickel (II) nitrate hexahydrate to produce a NiO corrosion resistant coating that is expected to resist chlorine-containing environments.

Significantly, the process of the present invention can be employed to produce a NiO coating over a non-nickel bearing substrate, i.e. a non-nickel bearing alloy, since it acts to substitute as a nickel-bearing material that is resistant to particular corrosive environments. An important practical application of the process of this invention is in the production of NiO coated tubes for utility steam generation service, and especially in the production of structural members exposed to the severe service environments present in refuse-burning or other boiler service burning processed and bulk municipal waste where corrosive fireside conditions due to chloride bearing corrodents are prevalent.

Another aspect of the present invention is drawn to the article of manufacture, i.e., structural members such as metal tubes, pipe or plate, particularly suited for severe service environments in refuse boilers burning processed and bulk municipal waste having a portion thereof provided with a corrosion resistant nickel oxide coating by the process of the present invention.

The nickel oxide coating produced according to the present invention can be applied to various substrates having Ni-Cr contents, most notably Inconel® Alloy 625. Potentially the most resistant coating for the present application is pure, or essentially pure nickel metal sprayed onto the surface before impregnation with the oxide itself. Inconel® Alloy 625 or 50% Cr, 50% Ni substrates could equally be coated by the method of the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The drawing is a print-out of an X-ray diffraction spectra taken of a coating produced according to the method of the present invention, proving the existence of a NiO coating over a non-nickel alloy substrate following the use of the present invention.

DESCRIPTION OF THE PREFERRED EMBODIMENT

The present invention is drawn to a process for producing a nickel oxide (NiO) ceramic surface coating on a substrate, and is particularly suited to the production of NiO coated tubes, pipes, plates and the like. The substrate can comprise nickel, for instance, nickel alloy, but this is not necessary to the successful practice of the present invention. The process involves applying a nickel (II) nitrate hexahydrate solution to the surface of an article to be coated and then heating the coated article to convert the nickel (II) nitrate hexahydrate solution to a NiO coating.

The solution used with the present invention comprises nickel (II) nitrate hexahydrate dissolved in water to saturation. Other names used for nickel (II) nitrate hexahydrate are: nickel nitrate, nickelous nitrate, nickelous nitrate hexahydrate, and $Ni(NO_3)_2 \cdot 6H_2O$. Other known solvents of nickel (II) nitrate hexahydrate are alcohol and $NH_4OH$. The solution may be applied to the article by brushing, spraying, or dipping.

While it is preferable to employ a saturated solution as described above, this is not necessary to a successful practice of the invention. A more dilute solution will work as well; such a more dilute solution will just not transfer as much of the chemical in each individual treatment.

The solution-coated article is then heated to above 303° C. (577° F.). The higher the temperature the solution-coated article is heated, the faster the solution converts to a NiO coating. Additionally, the removal of nickel (II) nitrate hexahydrate decomposition by-products, such as moisture, accelerates the conversion process.

It is noted that the heating cycle should begin slowly to assure that the applied solution is dried in place without causing boiling which could dislodge the chemical coating before conversion takes place.

EXAMPLE

The Solution:

Nickel Nitrate Hexahydrate and deionized water were mixed to make a solution for producing a NiO coating. 195 grams of Nickel Nitrate Hexahydrate was added to 200 grams (200 ml) of deionized water. The original goal was to obtain a saturated solution of Nickel Nitrate Hexahydrate and water; however, there was an insufficient amount of Nickel Nitrate Hexahydrate to create a saturated solution. The measured density of the solution that was used was 1.32 g/ml. The hydrometer used in measuring the density of the solution was a Fisher Brand, Specific Gravity Baume Heavy 60°/60° F., scale 1.000–2,000, stock No. 11–545, part No. 10180.

The Thermal Cycles:

The samples were exposed to three chemical application cycles. Each chemical application was followed by a thermal cycle. X-ray analysis shows that a NiO surface coating is apparent after one cycle. Each cycle was composed of an approximate 30 minute heat-up from 350° F. to 800° F. and an approximate thermal hold at 800° F. to 850° F. for 20 minutes. The thermal cycle parameters are not very critical. The important part of the cycle is that the material should be above at least 577° F. for a sufficient amount of time for the Nickel Nitrate Hexaydrate solution to convert to NiO.

1st Thermal Cycle:

10:52 am Load coated samples into preheated furnace #12

11:29 am 197° F.

11:51 am 265° F.

12:48 pm 350° F.—Main burners on, set point 1200° F.

1:03 pm 570° F.

1:15 pm 800° F.—Start hold, mains off

1:30 pm 850° F.—End of hold, air cool

2nd Thermal Cycle:

7:35 am 2nd coat applied to samples

9:39 am 280° F.—Mains on

10:20 am 800° F.—Start hold, mains off

10:35 am 848° F.—End of hold, air cool 3.rd Thermal Cycle:

7:40 am 3rd coating applied to samples

9:05 am 344° F.—Mains on, set point 1200° F.

9:45 am 820° F.—Start hold, mains off

10:00 am 855° F.—End of hold, air cool

The conversion coating produced according to the present invention can also be used in conjunction with a metallized coating of corrosion resistant composition. Examples of such metallurgical coatings include: Nickel 200 (99% Ni); Nickel-Chromium-Molybdenum-Columbium alloy (known commonly as Alloy 625) Ni-21.5, Cr-9 Mo-Cb-Ta; and 50% Nickel-50% Chromium. Typically, these metallized coatings contain pores, cracks, and other flaws that are inherent in the coating process. When a liquid coating is applied to the metallized surface, and then converted to ceramic oxide, the flaws are filled in with an equally resistant material (the nickel oxide), and the combined coating offers an impermeable barrier to corrosive specie. The nickel oxide conversion coating can be used as an impregnant for metallized coatings, for use in chlorine-containing environments such as the metal surfaces of refuse-burning boilers.

As shown in the drawing, NiO is the major crystalline phase present in the coating. The coating is present after only one treatment (painting and thermal processing) with a nickel nitrate solution. However, multiple treatments are recommended to produce a thicker coating. The FeCr crystalline phase is the result of an X-ray beam penetrating the coating layer into the metal surface or substrate, and therefore should not be considered a part of the coating layer.

Significantly, the process of the present invention can be employed to produce a NiO coating over a non-nickel bearing substrate, i.e. a non-nickel bearing alloy, since it acts to substitute as a nickel-bearing material that is resistant to particular corrosive environments. An important practical application of the process of this invention is in the production of NiO coated tubes for utility steam generation service, as well as in refuse-burning or other boiler service where corrosive fireside conditions are prevalent.

The advantages of the present invention are as follows: starting materials are commercially-available; conventional painting equipment can be used; it is a simple coating and thermal processing procedure; conventional air-atmosphere, low-temperature furnaces can be used; and NiO coatings can be produced on low-cost, non-nickel-bearing alloy substrates. The substrates can comprise tubes, pipe or plate materials of various chemical compositions. As used herein, the term "non-nickel bearing alloy substrate" means a substrate which contains little or no nickel, at least for the purpose of corrosion resistance. It is understood that some substrates may comprise alloys having relatively small amounts of nickel for purposes other than to achieve increased corrosion resistance, or that of themselves provide insufficient corrosion resistance for the environment involved. Such substrates are considered to be within the definition of the aforementioned non-nickel bearing alloy substrates. However, it is understood that some applications of the coating method of the present invention may involve substrates having significant levels of nickel therein. By way of example and not limitation,.the present invention can be applied to tubes, pipe or plate made of austenitic stainless steels which can have as much as 8–20% nickel.

While a specific embodiment of the invention has been shown and described in detail to illustrate the application of the principles of the invention, it will be understood that the invention may be embodied otherwise without departing from such principles.

We claim:

1. A method for coating a substrate with a corrosion resistant surface comprising the steps of:

providing a substrate;

coating a portion of the substrate with a metallized corrosion resistant composition prior to coating the portion of the substrate with a nickel (II) nitrate hexahydrate solution; and heating the solution-coated substrate to a temperature greater than 303° C. until a nickel oxide coating remains.

2. The method according to claim 1, wherein the substrate comprises nickel.

3. The method according to claim 1, wherein the substrate is a non-nickel bearing alloy substrate.

4. The method according to claim 1, including brushing the portion of the substrate with the nickel (II) nitrate hexahydrate solution.

5. The method according to claim 1, including spraying the portion of the substrate with the nickel (II) nitrate hexahydrate solution.

6. The method according to claim 1, including dipping the portion of the substrate in the nickel (II) nitrate hexahydrate solution.

7. The method according to claim 1, wherein the heating step begins slowly to assure that the applied coating solution is dried in place on the substrate without causing boiling which could otherwise dislodge the solution before conversion to the nickel oxide coating occurs.

8. The method according to claim 1, wherein the substrate comprises a metal tube, metal pipe or metal plate.

9. As an article of manufacture, a structural member having a portion thereof provided with a corrosion resistant surface of nickel oxide produced by the process of first coating that portion of the structural member which is to be provided with a corrosion resistant surface of nickel oxide with a metallized corrosion resistant composition, the metallized corrosion resistant composition being a member selected from the group consisting of Nickel 200, Nickel-Chromium-Molybdenum-Niobium alloy Ni-21.5, Cr-9 Mo-Ni-Ta, and 50% Nickel-50% Chromium, prior to coating that portion of the structural member with a nickel (II) nitrate hexahydrate solution and heating the solution-coated structural member to a temperature greater than 303° C. until a nickel oxide coating remains.

10. The article of manufacture of claim 9, wherein the structural member is a metal tube, metal pipe or metal plate.

11. The article of manufacture of claim 10, wherein the metal tube, metal pipe or metal plate comprises nickel.

12. As an article of manufacture, a structural member suited for severe service environments in refuse boilers burning processed and bulk municipal waste having a portion thereof exposed to the severe service environment which is provided with a corrosion resistant surface of nickel oxide produced by the process of:

(1) coating that portion of the structural member which is to be provided with a corrosion resistant surface of nickel oxide with a metallized corrosion resistant composition comprising a member selected from the group consisting of Nickel 200, Nickel-Chromium-Molybdenum-Niobium alloy Ni-21.5, Cr-9 Mo-Ni-Ta, and 50% Nickel-50% Chromium;

(2) coating the metallized corrosion resistant composition with a nickel (II) nitrate hexahydrate solution; and (3) slowly heating the solution-coated structural member to a temperature greater than 303° C. until a nickel oxide coating remains to assure that the applied coating solution is dried in place on the structural member without causing boiling which could otherwise dislodge the solution before conversion to the nickel oxide coating occurs.

13. The article of manufacture of claim 12, wherein the structural member is a metal tube, metal pipe or metal plate.

14. The article of manufacture of claim 13, wherein the metal tube, metal pipe or metal plate comprises nickel.

15. A method for coating a substrate with a corrosion resistant surface comprising the steps of:

providing a substrate;

coating a portion of the substrate with a metallized corrosion resistant composition comprising a member selected from the group consisting of Nickel 200, Nickel-Chromium-Molybdenum-Niobium alloy Ni-21.5, Cr-9 Mo-Ni-Ta, and 50% Nickel-50% Chromium, prior to coating the portion of the substrate with a nickel (II) nitrate hexahydrate solution; and heating the solution-coated substrate to a temperature greater than 303° C. until a nickel oxide coating remains.

* * * * *